US006306229B1

(12) United States Patent
Ide et al.

(10) Patent No.: US 6,306,229 B1
(45) Date of Patent: Oct. 23, 2001

(54) METHOD FOR PRODUCTION OF INVAR ALLOY STEEL SHEET MATERIAL FOR SHADOW MASK

(75) Inventors: Tsuneyuki Ide; Hironao Okayama; Hiroaki Ikenaga; Susumu Shigemasa; Yasuo Tahara; Taizo Sato; Akira Ikeda, all of Yamaguchi (JP)

(73) Assignee: Toyo Kohan Co., Ltd., Tokyo (JP)

( * ) Notice: Subject to any disclaimer, the term of this patent is extended or adjusted under 35 U.S.C. 154(b) by 0 days.

(21) Appl. No.: 09/423,431

(22) PCT Filed: May 8, 1998

(86) PCT No.: PCT/US98/02051

§ 371 Date: Feb. 23, 2000

§ 102(e) Date: Feb. 23, 2000

(87) PCT Pub. No.: WO98/51833

PCT Pub. Date: Nov. 19, 1998

(30) Foreign Application Priority Data

May 9, 1997 (JP) ..... 9-134473

(51) Int. Cl.[7] ..... C21D 8/00

(52) U.S. Cl. ..... 148/621; 148/651

(58) Field of Search ..... 420/94; 148/556, 148/676, 677, 336, 621, 651

(56) References Cited

U.S. PATENT DOCUMENTS 5,308,723 * 5/1994 Inoue et al. ..... 430/23

FOREIGN PATENT DOCUMENTS 6158229 6/1974 (JP) .
6452022 2/1989 (JP) .

* cited by examiner

*Primary Examiner*—Deborah Yee
(74) *Attorney, Agent, or Firm*—Browdy and Neimark

(57) ABSTRACT

An invar alloy steel sheet for shadow masks is provided which has improved etchability, an economical production method, a shadow mask made of the invar alloy steel sheet, and a color picture tube which incorporates the shadow mask. The invar alloy steel sheet is produced by hot working an alloy slab consisting of 33 top 40 wt % nickel with the balance being iron, and then subjecting the slab to a primary cold rolling at a rolling reduction ratio of not more than 80%, annealing at a temperature of at least 550° C., and subjecting the slab to a secondary cold rolling at a rolling reduction ratio of not more than 50%. The invar alloy steel sheet has a percentage of {100} texture of 60 to 80%.

1 Claim, No Drawings

METHOD FOR PRODUCTION OF INVAR ALLOY STEEL SHEET MATERIAL FOR SHADOW MASK

This application is a 371 of PCT/US98/02051 filed May 8, 1998.

DETAILED DESCRIPTION OF THE INVENTION

1. Technological Field

The present invention relates to an invar alloy steel sheet for a shadow mask for use in a color picture tube (hereinafter referred to as CRT), a method for producing same, a shadow mask made of the above mentioned invar alloy steel sheet, and a CRT incorporating the above mentioned shadow mask. More particularly, it relates to a steel sheet for a shadow mask made of an invar alloy having excellent etchability in forming dot holes (minute fine holes) of the shadow mask, method for producing the above mentioned invar alloy steel sheet, the above mentioned shadow mask, and a CRT incorporating the shadow mask.

2. Prior Art

As a material for a shadow mask for use in CRT, a thin sheet made of an invar alloy or aluminum killed steel is used. The sheet for a shadow mask made of invar alloy is produced by the steps of melting an invar alloy, casting the molten invar alloy, forging and hot rolling same, and then subjecting same to pickling and grinding for descaling, and thereafter cold rolling and annealing same. The thus obtained invar alloy thin sheet is perforated to form dot holes by the use of a photoetching method so that a flat mask can be produced. The flat mask is subjected to the steps of annealing, press-forming into a desired shape, and blackening, and then incorporated into a CRT.

A shadow mask serves as an anode for electron beams emitted from electron guns and as an iris diaphragm for allowing the electron beam that has passed through the dot holes to be projected onto dots of fluorescent coating spread over a front panel. Regarding the latter role, the dot holes directly affect sharpness, irregular color or irregular luminance of picture images displayed on the CRT, and therefore they require extremely high dimensional accuracy. A dot hole comprises a small hole diameter portion (hereinafter referred to as a small dot) provided on a surface of a thin plate-like mask sheet facing a cathodic side, i.e., opposed to the electron guns, a large hole diameter portion (hereinafter referred to as a large dot) provided on the other surface of the mask sheet facing the front panel, and a joint hole portion (Break Through Hole, hereinafter referred to as Br Th hole) at which the small dot and the large dot meet each other. The function of the iris diaphragm for the electron beam is substantially effected by this Br Th hole.

Generally, an invar allot steel sheet for shadow mask has a thickness of 100 to 250 $\mu$m and the pitch between both centers of the dot holes is approximately 250 $\mu$m in the case of a high definition shadow mask. The Br Th holes have each a diameter of about 120 $\mu$m and they should be round and have roundness uniform diameters. Further, the invar alloy steel sheet is strictly required to have an etched surface provided with a fine and uniform surface roughness in view of such a function if iris diaphragm. Accordingly, it is strongly required to improve characteristics for etching, i.e., etchability of such an invar alloy steel sheet for shadow mask.

As a method for improving etchability of an invar alloy sheet, some techniques for decreasing inevitable impurities in the invar alloy have been proposed in the disclosures such as Japanese Patent Publication No. Hei-2-51973 and Laid-open Japanese Patent No. Sho-61-190023, in which the amount of inevitable impurities such as C, O, and N is restricted. Truly, these proposed techniques are essential to a highly accurate etching technology for forming a shadow mask or the like, but even if the inevitable impurities are simply decreased, all the problem in etchability of the invar alloy cannot be solved. On the other hand, as a method for improving the metallurgical structure of an invar alloy, some techniques have been proposed in the disclosures such as Laid-open Japanese Patent No. Hei-61-39343, Japanese Patent Publication No. Hei-2-9655, and Laid-open Japanese Patent No. Hei-6-279946, in which grain size or crystal orientation is restricted. These techniques have been so far widely known and are also essential to the improvement in etchability of invar alloys. In a polycrystal material, the finer the crystal grain is, the rarer the chance for difference to occur among etching rates of grains with regard to crystal orientation, which enables the etching rates to be uniform. In addition, an invar alloy has a face-centered cubic lattice structure, which is the same kind of structure as that of austenitic stainless steel known as a stainless steel alloy in the steel material field. It is also well known that in a material having a face-centered cubic lattice structure, etching proceeds more uniformly in such high atomic density planes as {111} plane and {100} plane than other planes.

Thus, a simple combination of the above mentioned prior techniques cannot sufficiently provide an improvement in etchability of the invar alloy as a material for a high definition shadow mask. Besides, the industrial production of such invar alloys having minute and fine grain structures and crystal orientation structures requires complicated control systems throughout the processes of cold rolling, annealing, and so on, which constitutes a main factor of high cost. Today, there arises a stronger demand for a low cost shadow mask. A shadow mask and a shadow mask material of high grade and low cost are being sought after now.

Problem to Be Solved By the Invention

The present invention has an object to provide an industrially economical invar alloy steel sheet for a shadow mask material having more improved etchability, a method for producing the above mentioned invar alloy steel sheet, a shadow mask made of the invar alloy, and a color picture tube incorporating the above mentioned shadow mask.

Means for Solving the Problem

The invar alloy steel sheet for a shadow mask material according to claim 1 consists essentially of 33 to 40 wt % Ni and the balance being Fe, and the invar alloy steel sheet has a percentage of {100} texture of 60 to 80% in a rolled surface thereof.

The method for producing an invar alloy steel sheet material for a shadow mask as claimed in claim 2 comprises the steps of hot working an invar alloy slab consisting essentially of 33 to 40 wt % Ni and the balance being Fe, subjecting the hot worked invar alloy slab to a primary cold rolling at a rolling reduction ratio of not more than 80%, annealing same at a temperature of 550° C. or higher, and subjecting same to a secondary cold rolling at a rolling reduction ration of not more than 50%.

In the above mentioned method for producing an invar alloy steel sheet material for a shadow mask, the rolling reduction ratio in the primary cold rolling may preferably be 50 to 80% (as claimed in claim 3), the temperature in the annealing may preferably be 650 to 950° C. (as claimed in claim 4), and the rolling reduction ratio in the secondary cold rolling may preferably be 0.05 to 40% (as claimed in claim 5).

The shadow mask for use in a color picture tube as claimed in claim 6 employs the above mentioned invar alloy steel sheet.

The color picture tube as claimed in claim 7 incorporates the above mentioned shadow mask.

Preferred Embodiment

First, Ni content in an invar alloy is limited to 33 to 40 wt %. When the Ni content in the invar alloy is within the above mentioned range, the invar alloy has a remarkably decreased coefficient of thermal expansion. As a consequence, when a shadow mask made of this invar alloy is incorporated in a CRT, it can be free from problems such as distortion or irregular color of picture images, even when the temperature changes. On the other hand, when the Ni content is less than 33 wt %, or the Ni content exceeds 40 wt %, the coefficient of thermal expansion of the invar alloy increases, resulting in the above mentioned problem such as the distortion of picture images. A technological problem in the production of the invar alloy steel sheet for shadow mask for use in CRT is how to improve the etchability of the invar alloy. However, when priority is given to the improvement in the characteristics of the invar alloy sheet, conditions surrounding the industrial production of shadow mask become strict and the producing process becomes more complicated. It is necessary for improving etchability of the invar alloy within a range available to the industrial production that the invar alloy should have a percentage of {100} texture of 60 to 80% in a rolled surface thereof. In a case where the percentage of {100} texture is more than 80%, the invar alloy has a rather less improved etchability. In this case, conversely, the rolling reduction ratio in the cold rolling will be larger, which requires that the invar alloy be rolled time and again. As a consequence, the time of period for cold rolling will be longer, which causes a delay of the process. Moreover, the rolling rolls often suffer damages due to the work hardening if invar alloys, which results in high production costs. Besides, etching systems for the production of shadow mask have recently been remarkably advanced and it has become possible to spray a high temperature etching solution at a high pressure. Namely, a so-called "mechanical etching" by a pressurized spray rather dominantly proceeds in the dissolving reaction of the invar alloy. Thus, more improved etching circumstances are being given for the production of shadow mask. Therefore, it is necessary to limit the percentage of {100} texture of the invar alloy up to about 80%, considering the requirement for a price reduction in the production of shadow mask to an extent. On the other hand, when the percentage of {100} texture of the invar is less than 60%, the etchability thereof is decreased, so the lower limit is determined to be 60%.

From the view points mentioned above, the producing method for an invar alloy steel sheet which has a percentage of {100} texture being 60 to 80% will be explained below. A molten invar alloy consisting essentially of 33 to 40 wt % Ni and the balance of Fe is cast to form an ingot and forged, or cast through a continuous casting process to produce a slab, which is then hot worked into a hot coiled slab while eliminating the segregation. Descaling the surface of the slab is carried out by pickling or grinding using a grinder. Thereafter, the slab is subjected to a primary cold working, annealing, and secondary cold working to be finished into a steel sheet. The primary cold working is usually carried out by cold rolling using rolling rolls. The reduction ration is an important factor not only to a rolled plane structure of the invar alloy but also to the costs associated with the cold rolling process. As a result of various experiments, according to the present invention, the rolling reduction ratio in the primary cold rolling is determined to be preferably 80% or less, and more preferably 50 to 80%. When the rolling reduction ratio is less then 50%, it is impossible to attain a sufficient percentage of {100} texture in the rolled surface, but only a percentage of the plane being less than 60% is attained, which is under the lower limit of the percentage of {100} texture. Conversely, even when the rolling reduction ratio is more than 80%, the percentage of {100} texture is not so increased. In this case, not only the load on the rolling process unnecessarily increases but also the damage of the rolling rolls markedly increases, so the upper limit of the rolling reduction ratio is determined to be 80%. The annealing is performed as a following process for the purpose of recovering the rolled plane structure and recrystallization thereof at a temperature of 550° C. or more. This annealing has an effect on the improvement in the percentage of {100} texture. When the annealing temperature is lower than 550° C., the recrystallization cannot take place to a desired degree and the percentage of {100} texture is markedly decreased. Conversely, when the annealing temperature exceeds 950° C., the recrystallization is markedly accelerated and grains become larger, which causes the deterioration of etchability of the invar alloy sheet. Therefore, the annealing temperature range is more preferably 650 to 950° C. The secondary cold rolling is performed for the purpose of improving hardness and strength obtained by work hardening of the invar alloy so that the high percentage of {100} texture obtained by annealing can be maintained and a desired hardness can be imparted to the invar alloy steel sheet. Accordingly, the rolling reduction ratio in the secondary cold rolling is determined to be 50% or less. When the rolling reduction ratio is more than 50%, the high percentage of {100} texture obtained by annealing is diminished, thus losing the effect of annealing. Therefore, the rolling reduction ratio in the secondary cold rolling is preferably 50% or less and 0.05 to 40% more preferably. When the rolling reduction ratio is less than 0.05%, no difference is produced in hardness between the annealed invar alloy sheet and the secondarily cold rolled invar alloy sheet; that is, the secondary cold rolling has no remarkable effect on the invar alloy. The resultant invar alloy steel sheet cannot be provided with sufficient hardness and strength, which often causes troubles with transmitting the work during the etching process due to distortion of the sheet or the like. In general, the hardness required for an invar alloy is Hv (Vickers hardness)130 or more, while the invar alloy steel sheet of the present invention attains a hardness of Hv130 to 250.

Further, a percentage of {100} texture in the thus obtained invar alloy steel sheet for shadow mask is quantitatively evaluated using an X-ray diffraction method. This evaluation method includes a first step of determining a diffraction intensity of each of {111}, {100}, {110}, and {311} textures, and a second step of calculating the percentage of {100} texture by the use of the equation expressed as:

a percentage of {100} texture $$(\%)=100\times\{100\}/[\{111\}+\{100\}+\{110\}+\{311\}] \quad (1),$$

where {111}, {100}, and {311} represent the diffraction intensity of the restive textures.

Furthermore, etchability of the invar alloy steel sheet is quantatively evaluated using etch factor. The method of determination for etch factor includes a step of etching one side surface of the sheet and a next step of calculating the ratio between an etch depth and a side etch.

$$\text{Etch factor}=(\text{etch depth})/(\text{side etch}) \quad (2)$$

As expressed by the above equation (2), a material sheet having excellent etchability exhibits a less side etch (an etched length in a surface direction of the sheet) relative to an etch depth (an etched length in a thickness direction of the sheet by a spray solution), that is, the etch factor becomes a high value. On the other hand, a material sheet having inferior etchability exhibits a larger side etch, that is, the etch factor becomes a low value.

The mechanical property of a material sheet is determined by measuring the hardness of the material sheet for comparison. The method of determination for hardness is conducted using a Vickers hardness tester with a weight of 100 g.

EXAMPLES

The present invention is explained below in more detail referring to examples. An invar alloy steel sheet having a chemical composition of Sample A shown in Table 1 is melted, casted, forged, and subjected to a soaking heat treatment, hot rolling, and pickling in this order to produce a hot coiled steel sheet. Table 2 shows the production conditions of the primary cold rolling, annealing, and secondary cold rolling, respectively. Table 3 shows evaluation results of the characteristics of the material sheets obtained. The hardness is represented by Vickers hardness (Hv-100). If the hardness of a sample sheet is Hv130 or more, its evaluation result is given a remark of "possible". For, in general, a steel sheet is passed in a form of a strip on the etching line and therefore, unless the steel sheet has a Vickers hardness of 130 or more, the steel sheet cannot pass on the etching line normally. The percentage means a percentage of {100} texture, and the evaluation result is given a remark of "possible" if the percentage of {100} texture is 50 to 80%. The percentage of {100} texture is determined by the above mentioned X-ray diffraction method. As for etch factor, if the etch factor value is 2.6 or more, its evaluation result is given a remark of "possible". In Table 3, ○ stands for "possible" and × stands for "impossible".

TABLE 1

Composition of a sample of invar alloy steel sheet

| Sample | Composition (wt %) | | | | | | | | | |
|---|---|---|---|---|---|---|---|---|---|---|
| No. | C | Si | Mn | P | S | N | Al | Cu | Cr | Ni |
| A | 0.0014 | 0.020 | 0.23 | 0.001 | 0.0007 | 0.0025 | 0.001 | 0.014 | 0.013 | 36.4 |

TABLE 2

Production conditions for invar alloy steel sheet

| | Production conditions | | | | | | |
|---|---|---|---|---|---|---|---|
| | Primary cold rolling | | | Annealing | | Secondary cold rolling | |
| Sample No. | Before thickness (mm) | After thickness (mm) | Reduction ratio (%) | Temperature (° C.) | Time (min) | Thickness after (mm) | Reduction ratio (%) |
| 1 | 0.49 | 0.230 | 53.0 | 800 | 5 | 0.200 | 13.3 |
| 2 | 0.70 | 0.150 | 78.5 | 800 | 5 | 0.130 | 13.3 |
| 3 | 1.02 | 0.203 | 80.0 | 800 | 5 | 0.130 | 36.0 |
| 4 | 0.65 | 0.131 | 80.0 | 800 | 5 | 0.130 | 0.2 |
| 5 | 0.70 | 0.150 | 78.5 | 670 | 5 | 0.130 | 13.3 |
| 6 | 0.70 | 0.150 | 78.5 | 940 | 5 | 0.130 | 13.3 |
| 7 | 2.60 | 0.130 | 95.0 | 1000 | 5 | — | — |
| 8 | 1.73 | 0.260 | 85.0 | 1000 | 5 | 0.130 | 50.0 |
| 9 | 0.70 | 0.150 | 78.5 | 500 | 5 | 0.130 | 13.3 |
| 10 | 0.31 | 0.186 | 40.0 | 800 | 5 | 0.130 | 30.0 |

TABLE 3

Evaluation results of the characteristics of samples

| | Material Characteristics | | | | |
|---|---|---|---|---|---|
| Sample No. | Vickers Hardness (Hv-100) | Percentage of {100} Texture (%) | Etch factor | Evaluation Result | Division |
| 1 | 151 | 60 | 2.8 | ○ | Example |
| 2 | 150 | 68 | 2.7 | ○ | Example |
| 3 | 189 | 62 | 2.7 | ○ | Example |
| 4 | 145 | 79 | 2.8 | ○ | Example |
| 5 | 172 | 67 | 2.7 | ○ | Example |
| 6 | 139 | 71 | 2.7 | ○ | Example |

TABLE 3-continued

Evaluation results of the characteristics of samples

| Sample No. | Material Characteristics: Vickers Hardness (Hv-100) | Material Characteristics: Percentage of {100} Texture (%) | Material Characteristics: Etch factor | Evaluation Result | Division |
|---|---|---|---|---|---|
| 7 | 116 | 98 | 2.6 | x | Comparative example |
| 8 | 196 | 58 | 2.4 | x | Comparative example |
| 9 | 179 | 52 | 2.5 | x | Comparative example |
| 10 | 180 | 46 | 2.4 | x | Comparative example |

As clearly shown, any of the invar alloys of Sample No. 1 to 6 according to the present invention has sufficient material characteristics to satisfy the respective standard values, while the other invar alloys of Sample No. 7 to 10 according to comparative examples have at least one of the characteristics of hardness, percentage, and etch factor insufficient to the standard values.

EFFECT OF THE INVENTION

The invar alloy steel sheet for shadow mask material of the present invention is produced by the steps of hot working an alloy slab consisting essentially of 33 to 40 wt % Ni and the balance being Fe, subjecting the hot worked alloy slab to a primary cold rolling at a rolling reduction ratio of not more than 80%, annealing at a temperature of 550° C. or higher, and another cold rolling at a rolling reduction ratio of not more than 50% in this order. Thus, the invar alloy steel sheet for shadow mask material of the present invention can be economically produced and is provided with excellent etchability. The color picture tube which incorporates a shadow mask made of the above mentioned invar alloy steel sheet material is almost free from irregular color and irregular luminance and is excellent in the sharpness of picture images displayed on a screen.

What is claimed is:

1. A method for producing an invar alloy steel sheet material for a shadow mask, consisting of the steps of hot working an invar alloy slab consisting essentially of 33 to 40 wt % Ni and the balance being Fe, said invar alloy steel sheet having a percentage of {100} texture of 60 to 80% in a rolled surface thereof, subjecting the hot rolled invar alloy slab to a primary cold rolling at a rolling reduction ratio of 50 to 80%, annealing same at a temperature of 650 to 950° C., and subjecting same to a secondary cold rolling at a rolling reduction ratio of 0.05 to 40%.

* * * * *